US007246724B2

(12) United States Patent
Dave

(10) Patent No.: US 7,246,724 B2
(45) Date of Patent: Jul. 24, 2007

(54) DISPENSER FOR RECEIVING A CARTRIDGE OF MATERIAL HAVING RETRACTABLE PINS

(75) Inventor: Rajiv Bobby Dave, Edgware (GB)

(73) Assignee: GW Pharma Limited (GB)

( * ) Notice: Subject to any disclaimer, the term of this patent is extended or adjusted under 35 U.S.C. 154(b) by 516 days.

(21) Appl. No.: 10/505,296

(22) PCT Filed: Feb. 24, 2003

(86) PCT No.: PCT/GB03/00801

§ 371 (c)(1),
(2), (4) Date: Aug. 20, 2004

(87) PCT Pub. No.: WO03/070599

PCT Pub. Date: Aug. 28, 2003

(65) Prior Publication Data

US 2005/0115991 A1 Jun. 2, 2005

(30) Foreign Application Priority Data

Feb. 22, 2002 (GB) ..... 0204205.9

(51) Int. Cl.
*B65D 83/14* (2006.01)

(52) U.S. Cl. ..... 222/325; 222/153.03; 222/153.05; 222/153.11; 222/402.1; 222/402.11

(58) Field of Classification Search ..... 222/153.03, 222/153.05, 153.11, 402.11, 325, 402.1
See application file for complete search history.

(56) References Cited

U.S. PATENT DOCUMENTS

| | | | | |
|---|---|---|---|---|
| 4,058,120 | A * | 11/1977 | Caparrelli et al. | 128/203.12 |
| 5,240,147 | A * | 8/1993 | Frazier et al. | 222/153.03 |
| 5,425,404 | A * | 6/1995 | Dyer | 141/351 |
| 5,531,359 | A * | 7/1996 | Winner | 222/153.11 |
| 5,613,625 | A * | 3/1997 | Specht | 222/180 |
| 6,550,887 | B2 * | 4/2003 | Therien et al. | 347/22 |
| 6,929,154 | B2 * | 8/2005 | Grey et al. | 222/153.03 |

FOREIGN PATENT DOCUMENTS

GB 2 368 098 A 4/2002

* cited by examiner

*Primary Examiner*—J. Casimer Jacyna
(74) *Attorney, Agent, or Firm*—Wolf, Greenfield & Sacks, P.C.

(57) ABSTRACT

A dispenser having a socket (42) for receiving a cartridge (40) of material to be dispensed. The dispenser has a plurality of pins (44) which engage in apertures (36) in the cartridge to enable dispensing of the material. The pins are retractable, upon insertion of the cartridge into the socket, from a retracted position generally adjacent to the wall of the socket to a deployed position in which they engage with the apertures.

8 Claims, 4 Drawing Sheets

16
13

1
4
3
14
2
10
31
15
30
33
34
11
35
36
36
35
38
38
37

40
41
43
44
45
47
48
36

DISPENSER FOR RECEIVING A CARTRIDGE OF MATERIAL HAVING RETRACTABLE PINS

RELATED APPLICATIONS

This application is a national stage filing under 35 U.S.C. §371 of PCT International application PCT/GB03/00801, filed Feb. 24, 2003, which was published under PCT Article 21(2) in English, which claims priority to Great Britain patent application GB 1214205.9, filed Feb. 22, 2002, the entire contents of which applications are incorporated by reference herein.

The present invention relates to a dispenser. In particular, the invention relates to a dispenser for dispensing materials such as dangerous products like drugs, poison, toxic materials or the like.

Our earlier application GB 00 25811.1 discloses an apparatus for dispensing such materials. This apparatus has a device referred to as "an axial compression dispensing device". This device has a cartridge in which a security system is provided to prevent unauthorized dispensing of the material from the device. The cartridge has a housing containing a container filled with the material to be dispensed. The container is axially movable within the housing. Within the housing, beneath the container, is an upper plate arranged to contact the bottom of the container. The upper plate is linked by a frangible axial stem to a lower plate from which a plurality of posts project towards respectively aligned apertures in the lower face of the housing. This system is designed so that it will only operate with an authorized key. The key has a number of pins which correspond to the posts. These pins are inserted through the apertures and provide an axial force on the disc. In this way, the lower plate can be moved towards the container so that when a user generates an axial force to dispense material from the device, the container is held against axial movement away from the dispensing end of the cartridge and hence dispenses the material as required.

If unauthorized use is attempted by pushing a prong through one of the apertures, this will generate a bending force on the frangible member, which, if the force is increased, will then break. This then prevents the lower plate being moved axially to the position when it is required to be held for authorized dispensing.

The present invention is directed to a modification of the dispenser to improve this dispensing system.

According to the present invention, there is provided a dispenser having a socket for receiving a cartridge of material to be dispensed, the dispenser comprising a plurality of pins arranged, in use, to engage in a corresponding plurality of apertures in the cartridge to enable dispensing of the material, the dispenser further comprising a mechanism to move the pins, upon insertion of the cartridge into the socket, from a retracted position in which they will not engage with the apertures to a deployed position in which they will engage with the apertures.

With this arrangement, the pins can be moved into a retracted position. In this position their configuration does not match the configuration of apertures in the cartridge, such that the user is less likely to make the connection between the pins and the cartridge thus providing a further security mechanism. Preferably, if the pins are concealed from the view of the user, he will be unaware of the existence of the security mechanism. All that will be visible to the user is the apertures within the cartridge, but it will not be apparent what purpose these are serving.

Preferably, in the retracted position, the pins are adjacent to the wall of the socket. More preferably, recesses are provided in the walls of the socket, or an inwardly extending lip is provided around the open end of the socket, as this will provide cover for the pins in the retracted position.

Any form of mechanism may be used to deploy the pins, for example, a sensor may detect the insertion of the cartridge, whereupon a motor may deploy the pins. However, the mechanism to deploy the pins is preferably a mechanical arrangements, activated by contact between the cartridge and the mechanism, such that the insertion force of the cartridge deploys the pins.

Preferably the pins are provided on a plurality of arms which are pivotably attached within the socket. Preferably, these arms are arranged to abut one another in the deployed position. This provides a way of reliably locating the pins with respect to one another in the deployed position to ensure that they are correctly aligned with the apertures within the cartridge.

The socket may simply be left open. However, preferably, a cover is provided to close the open end of the socket, the cover being movable to an open position by the insertion of the cartridge.

An example of a dispenser in accordance with the present invention will now be described with reference to the accompanying drawings, in which.

Figure 1:
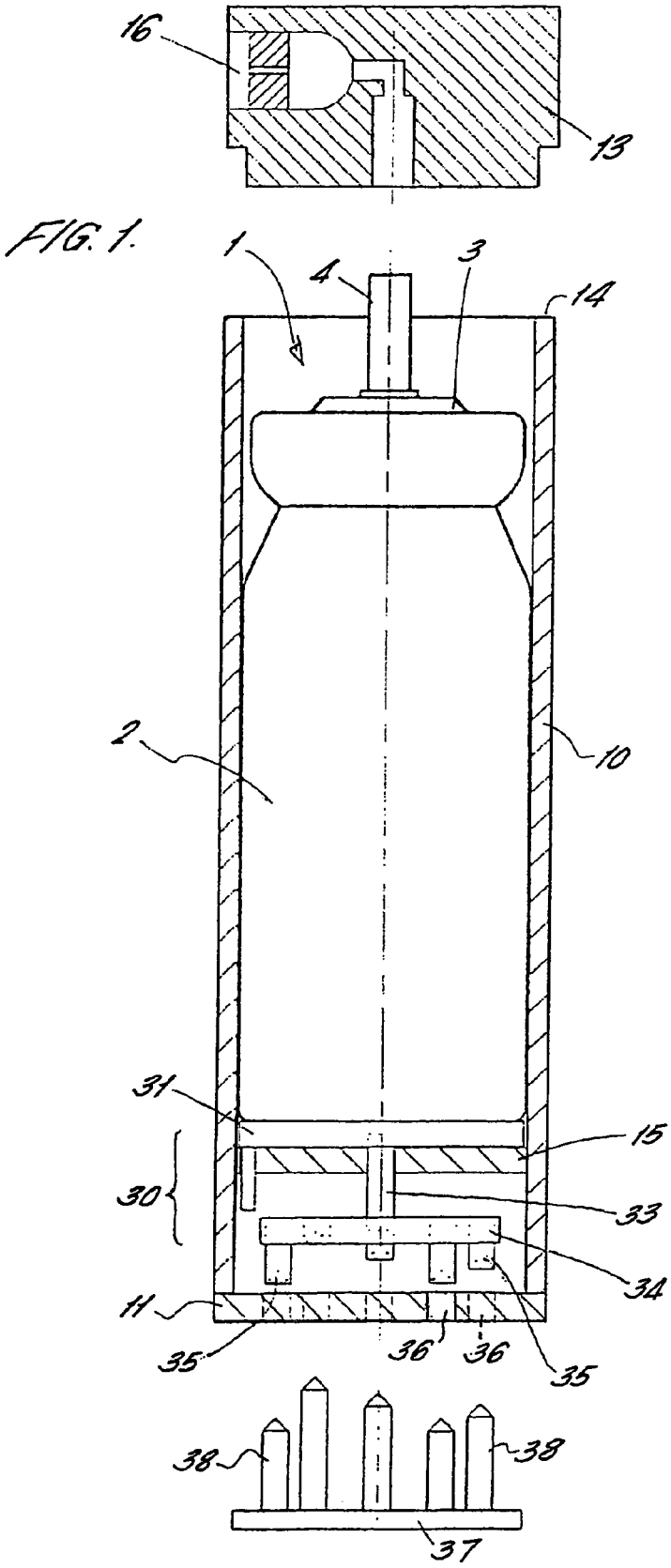
FIG. 1 is a diagrammatic sectional view of a secure dispensing device as disclosed in GB 00 25811.1.

Referring first to FIG. 1, this shows in diagrammatic sectional form a simplified secure dosage container as disclosed in GB 0025811.1. Denoted 1 is a standard small elongate pressurized aerosol container which has a generally cylindrical body 2 between a lower flat end and an upper end which is sealed by a swaged-on cover 3 carrying a valve housing with protruding valve stem 4. The contents are pressurized and there is a dip tube so that if valve stem 4 is moved downwards, material is dispensed from within pressurized container 1.

The outer housing consists of a generally cylindrical sleeve 10 having a transverse lower end wall 11, an intermediate apertured transverse wall 15 and a cap 13 which can be welded to the end of the cylindrical sleeve 10, e.g. at 14. Cap 13 includes an aerosol dispensing nozzle 16 of known design which is set substantially in the center of the cap and aligned appropriately with a transverse passage in the cap through which the nozzle can be seen in the drawing. Cap 13 is e.g. ultrasonically welded to the edge 14 of cylindrical portion 10 when the outer housing is assembled around the canister 2 and a plate and stem member generally denoted 30 shown in the drawing.

Plate and stem member 30 consists of, as seen in the drawing, an upper plate 31 adapted to contact the underside of body 2, a fracturable axial stem 33, and a lower plate 34 from which project a number (four are as shown in the drawing) of downwardly directed posts 35. These posts are of different downward axial extent and they are sized and located to match apertures 36 located in the end wall 11 of the outer casing. The stem member 30 passes through an aperture in the center of transverse wall 15.

The dimensions of the various components are so chosen that when the cap 13 is ultrasonically welded to edge 14, the plate and stem member 30 and pressurized canister 2 effectively occupy substantially the entire axial length of the interior of the outer housing.

The thickness of end wall 11 is chosen such that apertures 36 may provide axial guidance to a set of prongs 38 located on a key disc 39. Prongs 38 are of different heights corresponding to the heights of downwardly depending posts 35 on disc 34, and the arrangement of the prongs 38 is such that they can be registered with holes 36 and the end of prongs 38 then brought simultaneously into contact with the ends of posts 35. Further axial movement than that necessary to effect such contracting means that the disc 34 moves further away from wall 11, and disc 31 exerts pressure on the base of the pressurized canister 2 which, because it can move relative to the cap 13 which holds the nozzle, moves the dispensing tube 4 into the container, thus releasing material under pressure via nozzle 16.

If an attempt is made to effect such dispensing by pushing a prong through a single one of apertures 36, although it may contact the end of one of the downwardly depending posts 35, as soon as any pressure is applied, this will cause disc 34 to tilt, stem 33 to bend and then immediately break, and thereafter the pressure plate 31 cannot be raised by axial force transmitted through stem 33. Furthermore, it is not then possible to move canister 2 up by pushing a prong further in through hole 36, as plate 34 can only move up until it contacts the transverse fixed wall 15. Because the transverse wall 15 is fixed, although pushing a prong in through aperture 36 enables plate 34 to be abutted against wall 15, but not allow it to be moved any further, and in particular, because stem 33 is already broken, it does not allow pressure plate 31 to exert any pressure on the bottom of canister 2 which might effect dispensing.

As can be seen by contemplating FIG. 1, the secure dispensing container needs to be provided with a key to enable material to be dispensed from it, the key consisting of key disc 39 with the actuating posts 38 of different heights on it. An additional benefit of the particular presentation shown in FIG. 1 is that it is easy to position a seal across the end of wall 11 covering the apertures 36, which seal must be pierced by the prongs 38 when the dispensing device is first used, or which must be torn off in order to provide access to apertures 36 for posts 38. In either event, it is clear whether the dispensing device has been put to use or not.

In the present invention, the key disc 39 is replaced by a system of retractable pins as will now be described with reference to FIGS. 2 to 4.

Figure 2:
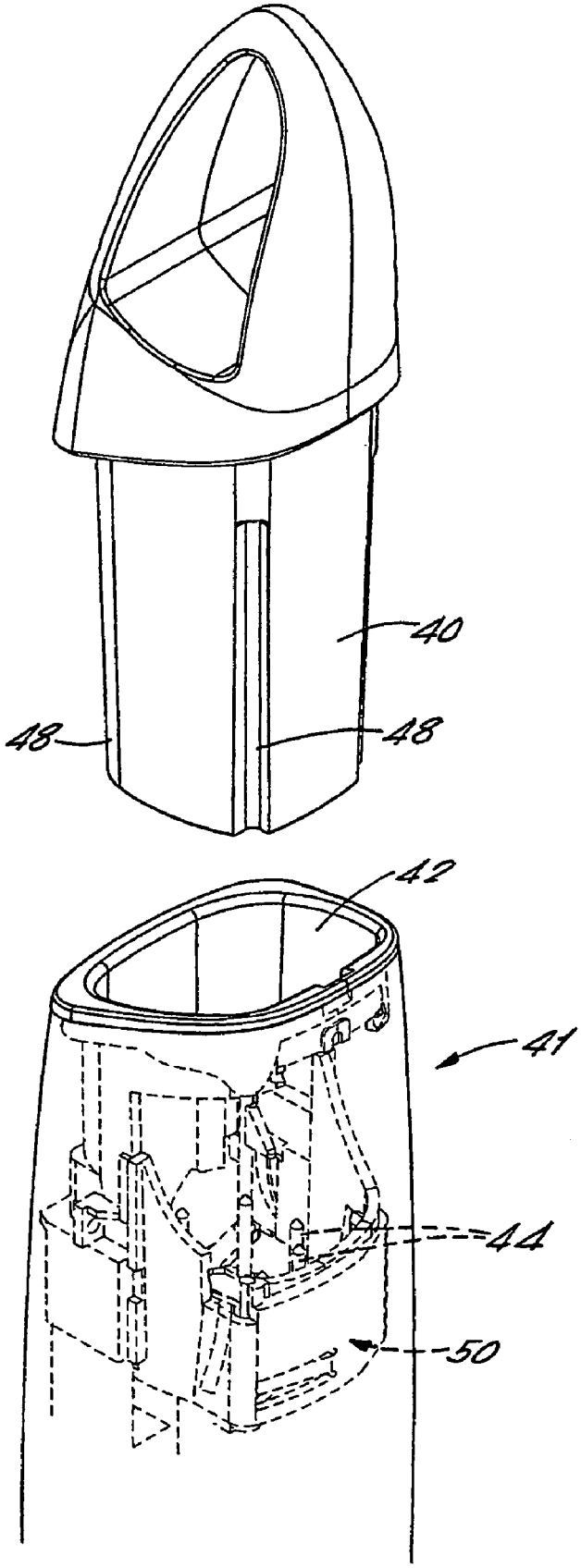
FIG. 2 is a perspective view of a cartridge and dispenser in accordance with the present invention in which the internal mechanism with the dispenser is shown in dashed lines.
Figures 3A, 3B, 3C:
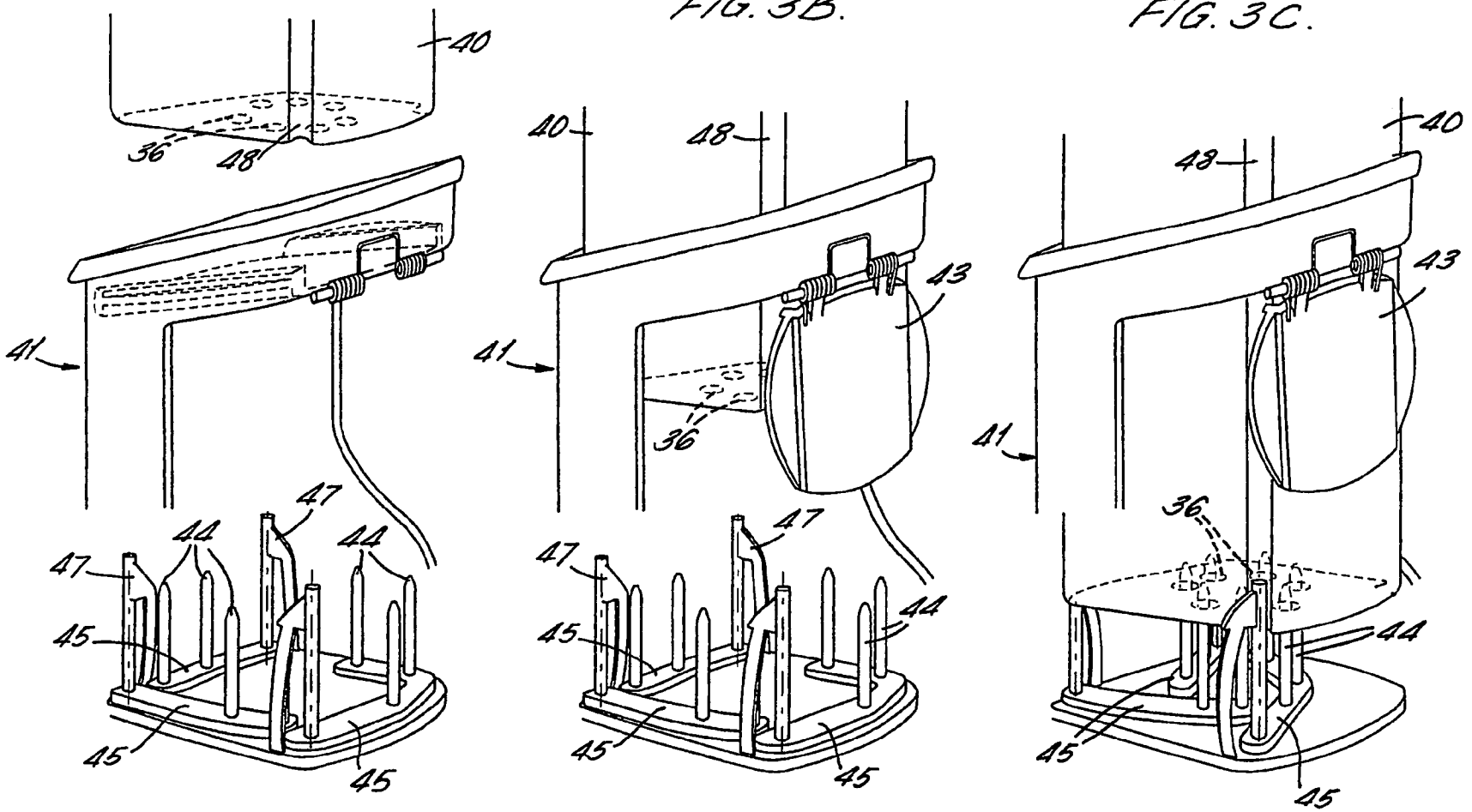
FIGS. 3A to 3C are schematic perspective views of various stages of the insertion of the cartridge into the dispenser.

FIGS. 2 and 3 show a cartridge 40 which operates according to the principle described with reference to FIG. 1. The dispenser 41 has a socket 42 to receive the cartridge 40. The socket 42 is closed by a spring loaded lid 43 shown in FIGS. 3B and 3C. This is simply provided to keep dust out of the socket 42.

Figure 4B:
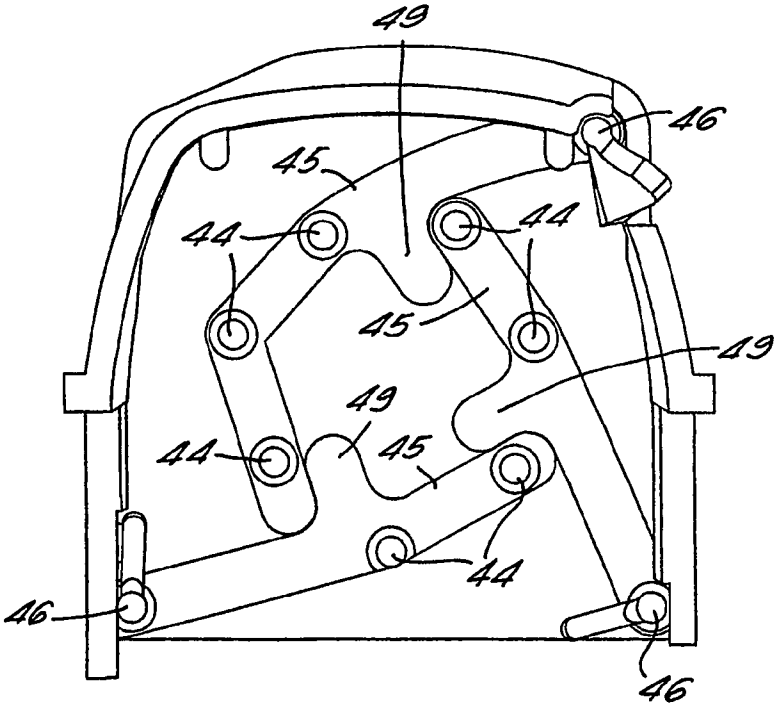
FIGS. 4A and 4B are plan views showing the position of the pins in the retracted and deployed positions respectively.
Figure 4A:
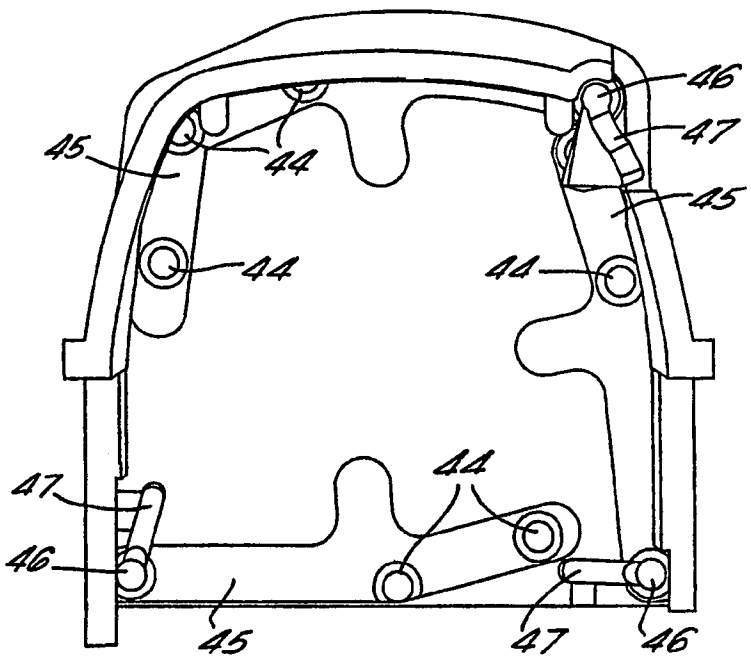

Within the socket 42 are a plurality of pins 44 (seven of which are shown in this particular example). These pins are provided on three pivotal arms 45. Each of these arms is pivoted about a pivot point 46 in the corner of the socket 42 as best shown in FIGS. 4A and 4B. At each of these corners is a spigot 47 which extends towards the mouth of the socket 42. These spigots provide cam surfaces which engage with complementary axially extending grooves 48 at each corner of the cartridge 40 which generates a force to rotate the arms 45 from the position shown in FIGS. 3A and 4A, via the intermediate position of FIG. 3B, to the final position of FIGS. 3C and 4B. In this position, the pins 44 are positioned such that they fit into the apertures 36 in the bottom of the cartridge 40. As shown in FIG. 4B, each of the arms 45 contains an abutment portion 49 which abuts against an adjacent arm so that the pins are positively positioned in the correct position.

This pin assembly is provided on a carrier 50 which is axially movable within the socket 42. This carrier is selectively locked in place by an electromechanical latch (not shown). When the carrier is unlocked, pressing the cartridge 40 into the socket causes it to move up and down with the carrier so that no dispensing takes place. When the carrier is locked, pressing the cartridge into the socket causes the pins to provide an axial force on the posts 35 generating sufficient force to dispense material as described above.

The invention claimed is:

1. A dispenser having a socket for receiving a cartridge of material to be dispensed, the dispenser comprising a plurality of pins arranged, in use, to engage in a corresponding plurality of apertures in the cartridge to enable dispensing of the material, the dispenser further comprising a mechanism to move the pins, upon insertion of the cartridge into the socket, from a retracted position in which they will not engage with the apertures to a deployed position in which they will engage with the apertures.

2. A dispenser according to claim 1, wherein in the retracted position, the pins are adjacent to the wall of the socket.

3. A dispenser according to claim 2, wherein recesses are provided in the walls of the socket to receive the pins in the retracted position.

4. A dispenser according to claim 2, wherein an inwardly extending lip is provided around the open end of the socket.

5. A dispenser according to claim 1, wherein the mechanism to deploy the pins is a mechanical arrangement activated by contact between the cartridge and the mechanism such that the insertion force of the cartridge deploys the pins.

6. A dispenser according to claim 1, wherein the pins are provided on a plurality of arms which are pivotably attached within the socket.

7. A dispenser according to claim 6, wherein the arms are arranged to abut one another in the deployed position.

8. A dispenser according to claim 1, wherein a cover is provided to close the open end of the socket, the cover being moveable to an open position by insertion of the cartridge.

* * * * *